US006915599B2

(12) United States Patent
Lohnes et al.

(10) Patent No.: US 6,915,599 B2
(45) Date of Patent: Jul. 12, 2005

(54) SYSTEM FOR CONTROLLING MOVEMENT OF A WORK MACHINE ARM

(75) Inventors: Rob L. Lohnes, Marquette Heights, IL (US); Roger D. Koch, Pekin, IL (US); Jeffrey S. Alig, Morton, IL (US); Robert J. Price, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/646,730

(22) Filed: Aug. 25, 2003

(65) Prior Publication Data

US 2005/0044753 A1 Mar. 3, 2005

(51) Int. Cl.[7] ..... E02F 3/32
(52) U.S. Cl. ..... 37/348
(58) Field of Search ..... 37/348, 195, 395–397, 37/414, 466; 172/2–11; 414/728, 730, 732, 733, 738, 800; 701/50

(56) References Cited

U.S. PATENT DOCUMENTS 5,333,533 A * 8/1994 Hosseini ..... 91/361
5,446,980 A * 9/1995 Rocke ..... 37/348
5,493,798 A * 2/1996 Rocke et al. ..... 37/348
5,995,893 A 11/1999 Lee et al.
6,129,155 A 10/2000 Lombardi
6,140,787 A 10/2000 Lokhorst et al.
6,185,493 B1 2/2001 Skinner et al.
6,356,829 B1 3/2002 Fan et al.
6,374,147 B1 4/2002 Rockwood
6,374,153 B1 4/2002 Brandt et al.
6,434,437 B1 8/2002 Brandt et al.
6,473,679 B1 10/2002 Tady et al.
6,604,305 B2 * 8/2003 Koch ..... 37/348
2003/0061742 A1 4/2003 Koch

* cited by examiner

*Primary Examiner*—Robert E Pezzuto
(74) *Attorney, Agent, or Firm*—Finnegan, Henderson, Farabow, Garrett & Dunner

(57) ABSTRACT

A method of controlling the movement of a work machine arm having a series of hydraulic cylinders operatively engaged with the work machine arm includes receiving a signal from an input device to change the position of the work machine arm and determining an extension amount of one or more of the series of hydraulic cylinders. The extension amount of one or more of the series of hydraulic cylinders is changed to effect the change in the position of the work machine arm. The changes in the extension amount of the one or more of the series of hydraulic cylinders are ordered based on a pre-selected priority of movement.

34 Claims, 5 Drawing Sheets

SYSTEM FOR CONTROLLING MOVEMENT OF A WORK MACHINE ARM

TECHNICAL FIELD

This invention relates to a system and method for automatically controlling the movement of an arm on a work machine.

BACKGROUND

Work machines are often equipped with a work machine arm capable of performing any number of tasks. For example, a work machine such as a backhoe or an excavator may include a digging work machine arm. Likewise, a work machine such as a forklift or a telescopic material handler may include a work machine arm for lifting and carrying objects. Other work machines may include work machine arms that are adapted to support vibratory compactors or other equipment.

Because controlling a work machine arm is often a complex process, an inexperienced operator may have difficulty moving an element of the work machine arm, such as a work implement, along a desired path. To simplify the coordination required to accomplish this, some work machines are provided with a single input device that controls the movement of all the components of the work machine arm. Use of a single input device may simplify the operation of the work machine arm and reduce operator fatigue.

U.S. Pat. No. 6,374,153 to Brandt et al. discloses an apparatus and method for providing coordinated control to a telescopic material handler. Often, a material handler is used to raise a pallet in a vertical direction. The coordinating apparatus of the '153 patent enables an operator to more easily control the material handler arm so that it moves along the vertical path by simultaneously changing both the length and the angle of the boom. The '153 patent discloses a control system that calculates a compensating error that may develop when one hydraulic cylinder does not receive the necessary hydraulic fluid flow due to the demand of flow from another cylinder.

At times, it may be desirable to move different components of the work machine arm in an order of priority that can be adapted to the needs of a specific work site. For example, when a work machine arm is used to dig in an area adjacent a standing structure, a bucket on the work machine arm must be extended so that the bucket edge approaches the wall before the back of the bucket. In another example, the life of a specific, expensive component of the work machine arm may be prolonged by using it only when necessary. Current work machines having systems for coordinated movement do not provide for prioritizing the movement of different components of the work machine arm.

The present invention is directed to overcoming one or more of the disadvantages of the prior art.

SUMMARY OF THE INVENTION

In one aspect, a method of controlling the movement of a work machine arm having a series of hydraulic cylinders operatively engaged with the work machine arm is disclosed. The method includes receiving a signal from an input device to change the position of the work machine arm and determining an extension amount of one or more of the series of hydraulic cylinders. The extension amount of one or more of the series of hydraulic cylinders is changed to effect the change in the position of the work machine arm. The changes in the extension amount of the one or more of the series of hydraulic cylinders are ordered based on a pre-selected priority of movement.

In another aspect, a system for controlling the movement of a work machine arm having a series of hydraulic cylinders operatively engaged with the work machine arm is disclosed. The system includes an input device operable to generate a signal to change the position of the work machine arm and at least one sensor associated with one or more of the series of hydraulic cylinders for determining an extension amount of the one or more of the series of hydraulic cylinders. A control module is adapted to receive the signal from the input device and to change the extension amount of one or more of the series of hydraulic cylinders to affect the change in the position of the work machine arm. The changes in the extension amount of the one or more of the series of hydraulic cylinders are ordered based on a pre-selected priority of movement.

DETAILED DESCRIPTION

Figure 1:
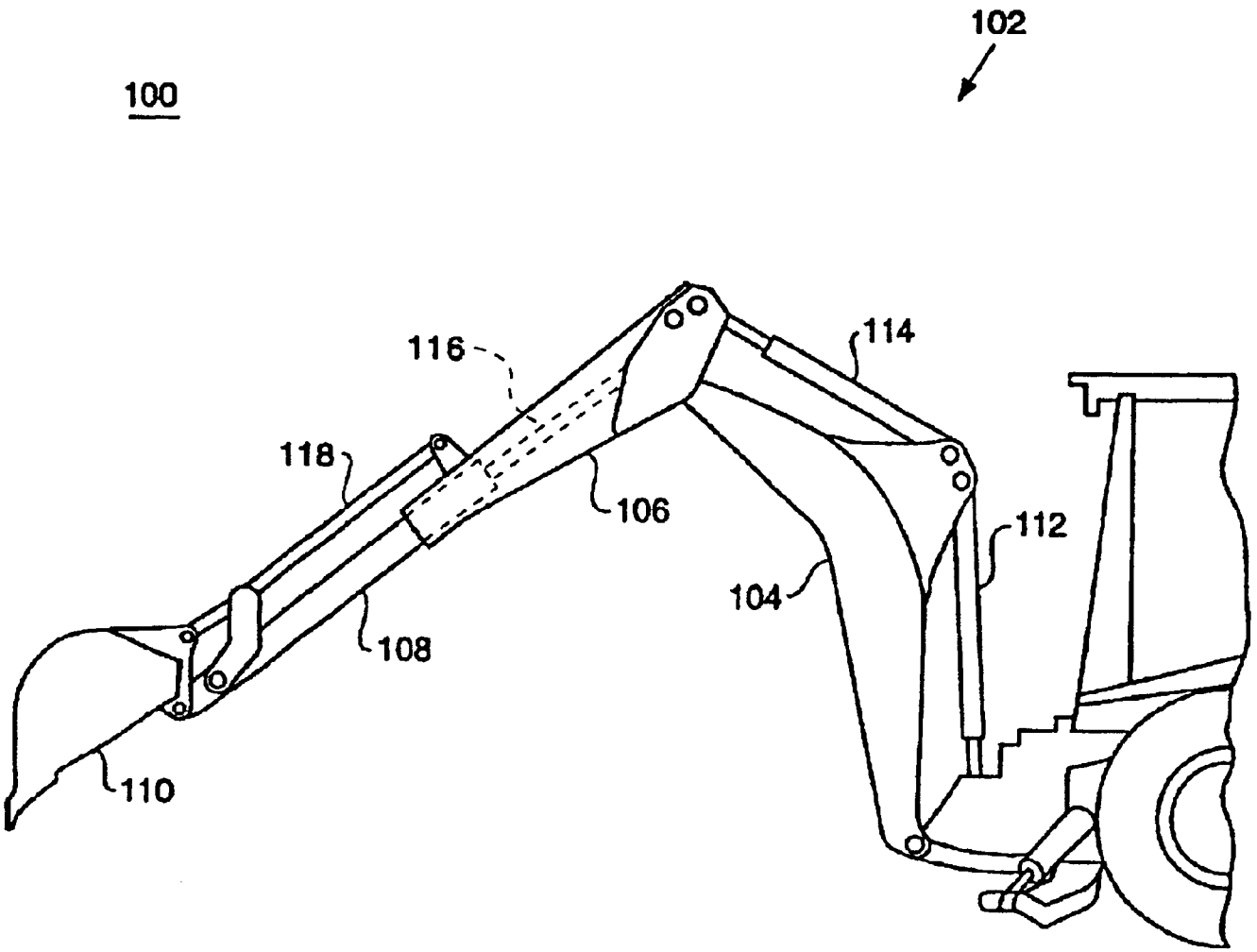
FIG. 1 is a diagrammatic illustration of a portion of a work machine suited for use with the present invention.

FIG. 1 is a work machine 100 shown in relevant portion as a backhoe loader, that may be used for a wide variety of earth-working and construction applications. Although the work machine 100 is shown as a backhoe loader, it is noted that other types of work machines 100 having multiple linkages, e.g., excavators, front shovels, material handlers, and the like, may be used with embodiments of the disclosed system.

The work machine 100 includes a work machine arm 102 having a boom 104, a stick 106, an extendable stick (E-stick) 108, and a work implement 110, all controllably attached to the work machine 100. A boom cylinder 112 extends from the boom 104 to a body of the work machine 100 and is adapted to pivotally move the boom 104 with respect to the body of the work machine 100. A stick cylinder 114 extends between the stick 106 and the boom 104 and is adapted to move the stick 106 with respect to the boom 104.

An E-stick cylinder 116 extends between the stick 106 and the E-stick 108. The E-stick 108 and the E-stick cylinder 116 are contained within the stick 106 so that the E-stick 108 controllably slides, i.e., extends and retracts, relative to the stick 106. The work implement 110 is pivotally connected to the E-stick 108 and is moved by a work implement cylinder 118, extending from the E-stick 108 to the work implement 110.

Figure 2:
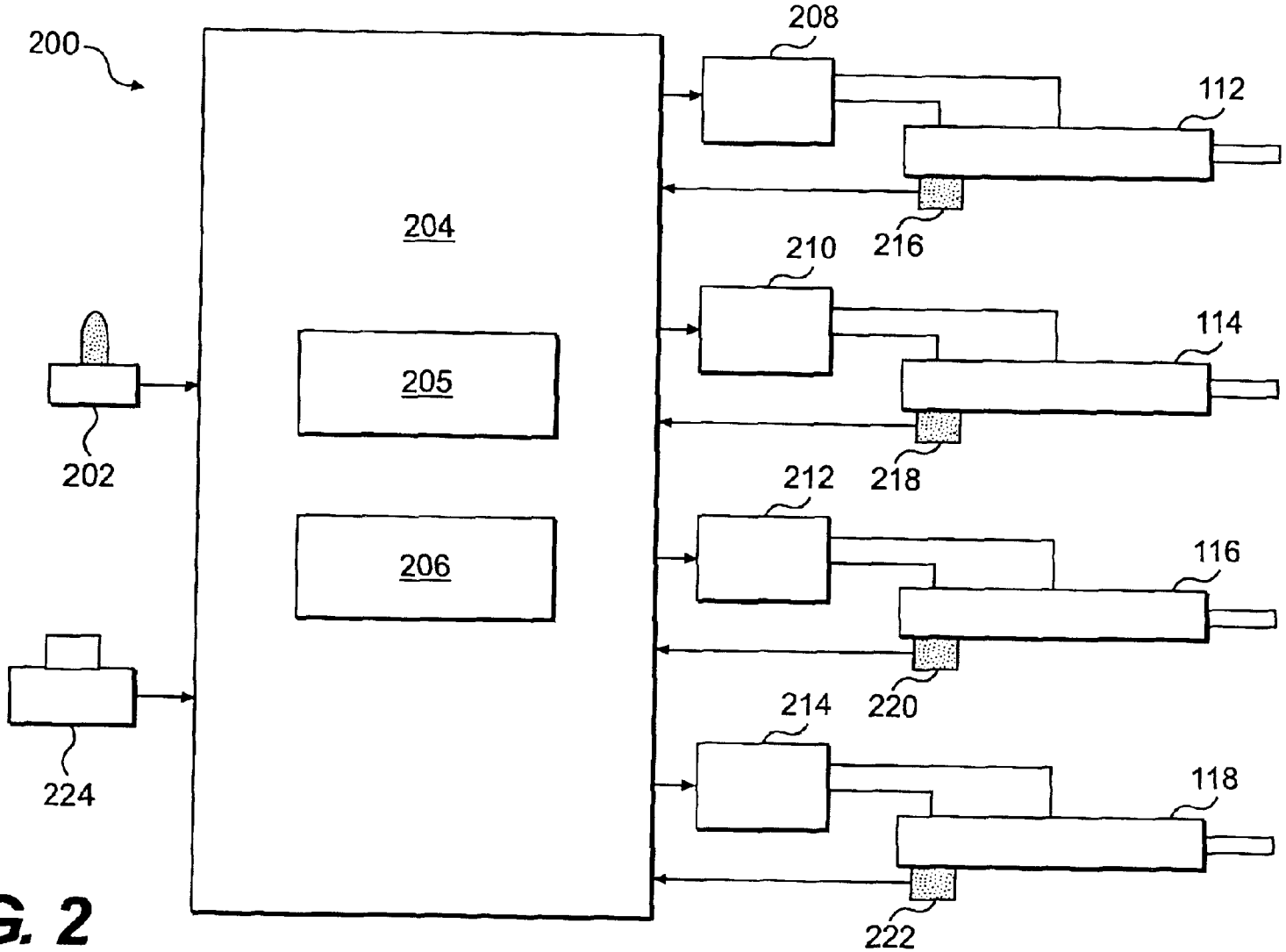
FIG. 2 is a block diagram illustrating an exemplary controller for operating a work machine arm.

Hydraulic cylinder valves, shown in FIG. 2, may control the extension and retraction of the hydraulic cylinders 112, 114, 116, 118. A boom valve 208 may be associated with the boom cylinder 112, a stick valve 210 may be associated with the stick cylinder 114, an E-stick valve 212 may be associated with the E-stick cylinder 116, and a work implement valve 214 may be associated with the work implement cylinder 118. The position of valves 208, 210, 212, 214 may be controlled to coordinate the flow of hydraulic fluid to thereby control the rate and direction of movement of the associated hydraulic cylinder 112, 114, 116, 118. It should be noted that the term "extension amount" represents both the amount of extension or retraction of the hydraulic cylinders 112, 114, 116, 118.

FIG. 2 shows a controller 200 for operating and controlling the movement of the work machine arm 102. As described in greater detail below, the controller 200 may be adapted to move the components of the work machine arm 102 in an order that is based on a pre-selected priority of movement. For the purposes of this application, the term "pre-selected priority of movement" refers to a hierarchy of movement where the relative position of one or more of the hydraulic cylinders 112, 114, 116, 118 is changed only after another of the hydraulic cylinders 112, 114, 116, 118 is extended or retracted beyond a pre-designated position or amount. Accordingly, the pre-selected priority of movement prioritizes the movement of the boom cylinder 112, the stick cylinder 114, the E-stick cylinder 116, and the work implement cylinder 118. The cylinder with the higher priority is moved to or beyond a certain point before moving a cylinder with lower priority The controller 200 includes an input device 202 and a control module 204 for operating valves 208, 210, 212, 214 to control the position and movement of hydraulic cylinders 112, 114, 116, 118 on the work machine arm 102. It may also include displacement sensors 216, 218, 220, 222 associated with, and adapted to monitor the position of the hydraulic cylinders 112, 114, 116, 118. A mode selector 224 may also be associated with the control module 204.

The input device 202 could be a joystick, keyboard, lever, or other input device known in the art. Adapted to generate a desired movement signal, the input device 202 receives an input from an operator and sends it to the control module 204. In the exemplary embodiment shown, the controller 200 includes a single input device for controlling the operation of the boom cylinder 112, the stick cylinder 114, the E-stick cylinder 116, and work implement cylinder 118. However, other input devices may be used to control the operation of one or more of the cylinders independent of the input device 202 and the pre-selected priority of movement.

For example, in one exemplary embodiment, the input device 202 controls only the movement of the stick cylinder 114, the E-stick cylinder 116, and the work implement cylinder 118. In this exemplary embodiment, the boom cylinder 112 is controlled by a separate input device for independent control of the boom 104. Accordingly, in this embodiment, only the stick cylinder 114, the E-stick cylinder 116, and the work implement cylinder 118 are subject to the pre-selected priority of movement.

The control module 204 may include a processor 205 and a memory device 206. The memory device 206 may store one or more control routines or prioritized modes, which could be software programs, for controlling the work machine arm 102 based on the pre-selected priority of movement. The processor receives the input signal from the input device 202 and executes the routines or prioritized modes to generate and deliver a command signal to actuate the hydraulic cylinder valves 208, 210, 212, 214 that are associated with the hydraulic cylinders 112, 114, 116, 118 of the work machine arm 102 according to the pre-selected priority of movement.

As shown in FIG. 2, a displacement sensor may be associated with each hydraulic cylinder. For example, a boom displacement sensor 216 may be associated with the boom cylinder 112, a stick displacement sensor 218 may be associated with the stick cylinder 114, an E-stick displacement sensor 220 may be associated with the E-stick cylinder 116, and a work implement displacement sensor 222 may be associated with the work implement cylinder 118. The displacement sensors 216, 218, 220, 222 may be used to measure the extension amount of the hydraulic cylinders 112, 114, 116, 118. The displacement sensors 216, 218, 220, 222 may be in communication with the control module 204, and may provide signals to the control module 204 indicative of the cylinder extension amounts. The control module 204 may monitor one or more of the displacement sensors 216, 218, 220, 222 at a single time, but does not need to monitor them all at the same time. The control module 204 may use the information received from the displacement sensors 216, 218, 220, 222 to prioritize and order movement of the work machine arm 102 based on the pre-selected priority of movement.

In the exemplary embodiment shown, the controller 200 includes more than one control routine or prioritized mode. Accordingly, a mode selector 224 is provided in communication with the control module 204. The mode selector 224 is an input device that allows an operator to select or choose from the available modes, and could be a toggle, joystick, dial, or any other input device known in the art. Accordingly, the operator can select the priority of movement of the work machine arm 102 that will provide the desired results for the work site.

The work machine 100 may include any number of modes and each mode may be different and may be based upon a specific use or function of the work machine. For example, one exemplary mode may be a digging mode, where the pre-selected priority of movement requires that the stick cylinder 114 and the boom cylinder 112 be substantially fully extended before allowing movement of either the work implement cylinder 118 or the E-stick cylinder 116. The priority of movement may allow simultaneous extension of the boom cylinder and the stick cylinder, or may require that they too be moved in order, based on the priority of movement.

Other modes having a different pre-selected priority of movement may be used to accomplish other desired purposes. For example, in one exemplary mode, the pre-selected priority of movement prioritizes only the movement of the stick 106, the E-stick 108, and the work implement 110. In this exemplary mode, the pre-selected priority of movement allows movement of the work implement cylinder 118 only after the stick cylinder 114 is extended or retracted beyond a designated point. And the E-stick cylinder 116 may be moved only after the work implement cylinder 118 is extended or retracted beyond a designated point. In this exemplary mode, the extension and control of the boom 104 may be operated independently of and outside of the pre-selected priority of movement. For example, control and operation of the boom 104 may be controlled separately through an input device specific to the boom 104, such as a boom joystick.

In another exemplary mode, only the stick cylinder 114 and the work implement cylinder 118 are controlled by the pre-selected priority of movement. Accordingly, the pre-selected priority of movement allows movement of the work implement cylinder 118 only after the stick cylinder 114 is extended or retracted beyond a designated point. In this exemplary embodiment, the movement of the E-stick cylinder 116 and the movement of the boom cylinder 112 may be independently controlled by, for example, a separate boom joystick and a separate E-stick joystick.

In yet another exemplary mode, the pre-selected priority of movement controls only the stick cylinder 114 and the E-stick cylinder 116. Accordingly, the pre-selected priority of movement may allow movement of the E-stick cylinder 116 only after the stick cylinder 114 is extended or retracted beyond a designated amount. In this exemplary mode, the boom cylinder 112 and the work implement cylinder 118 may be independently controlled and not based on the priority of movement. In any exemplary mode, the pre-selected priority of movement during retraction of the work machine arm 102 may or may not be the reverse of the pre-selected priority during extension of the work machine arm 102. Other modes would be apparent to one skilled in the art.

It should be noted that any mode may be adapted to include an optional transitioning feature for smoothly transitioning the movement from one hydraulic cylinder to the next hydraulic cylinder. This transitioning feature may be used to slow, or ramp down the velocity of one hydraulic cylinder when it is extended or retracted beyond the pre-designated position, while at the same time, ramping up the velocity of the next hydraulic cylinder. So doing provides a smooth transition between hydraulic cylinders as the work machine arm is operated.

Figure 3:
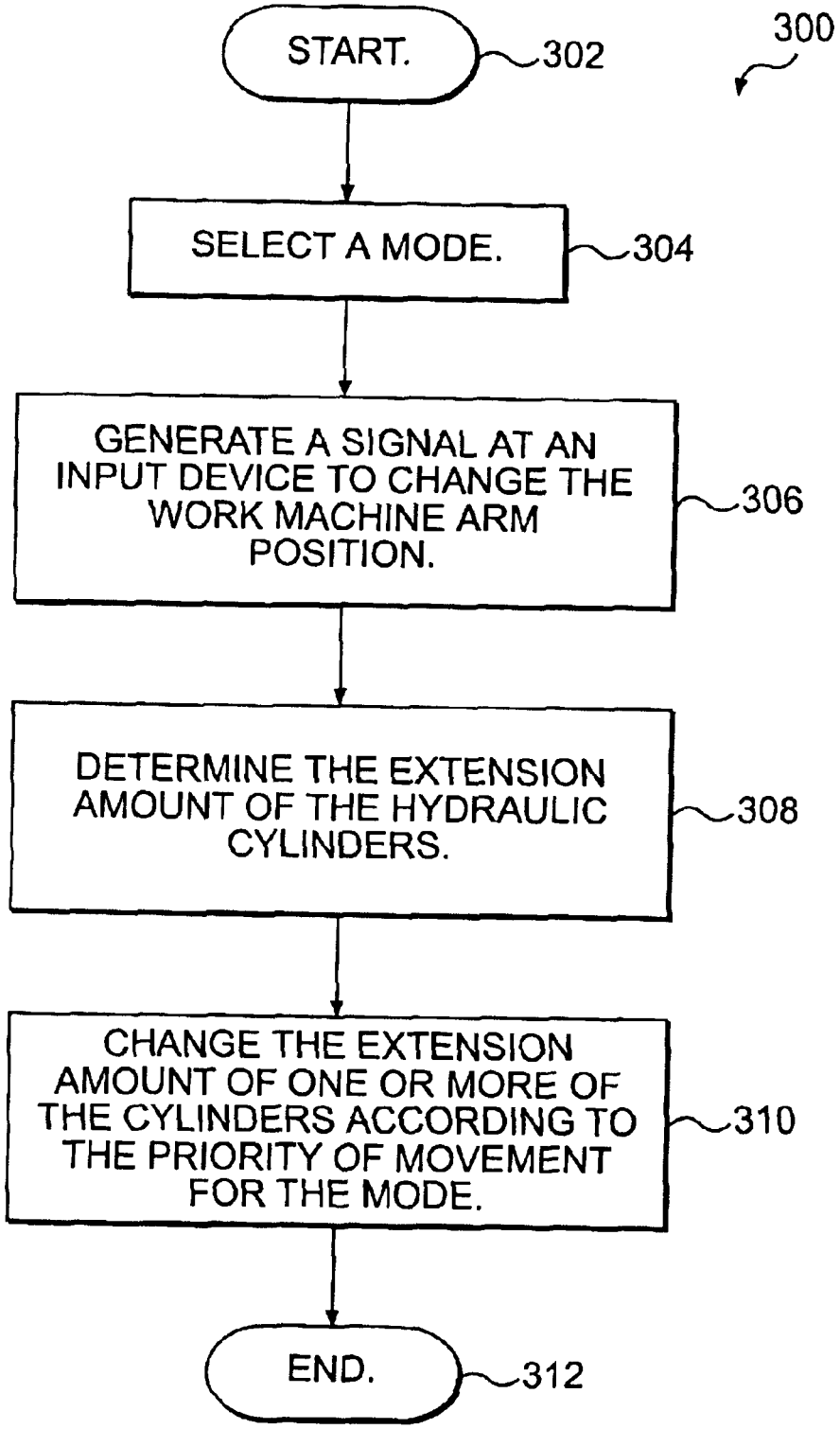
FIG. 3 is a flow chart showing an exemplary method for controlling a work machine arm using a pre-selected priority of movement.

FIG. 3 is a block diagram 300 showing steps for moving the work machine arm 102 based on the pre-selected priority of movement. The flow chart 300 begins at a start step 302. At a step 304, an operator selects a mode on the work machine 100 using the mode selector 224. The selected mode may be any routine or process that controls the movement of the work machine arm 102 using a pre-selected priority of movement.

At a step 306, the input device 202 generates a signal to change the position of the work machine arm 102. The signal is sent from the input device 202 to the control module 204. At a step 308, the control module 204 determines the extension amount of the hydraulic cylinders 112, 114, 116, 118 on the work machine arm 102 based upon measurements taken and signals received from the respective displacement sensors 216, 218, 220, 222. At a step 310, the control module 204 adjusts the extension amount of one or more of the hydraulic cylinders 112, 114, 116, 118 on the work machine arm 102 according to the priority of movement for the mode, and further based upon the signal received from the input device 202. At a step 312, the flow chart 300 ends.

Figure 4:
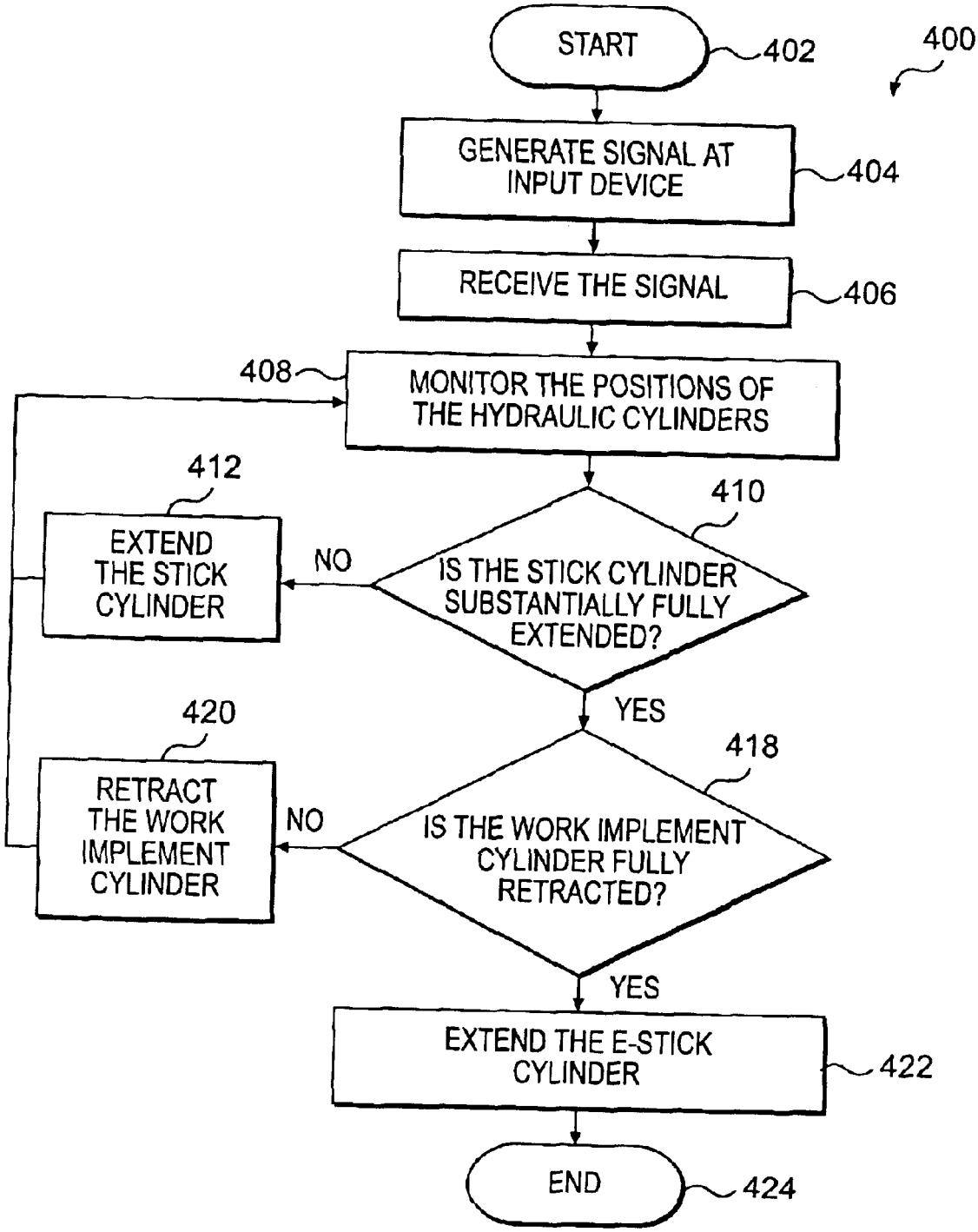
FIG. 4 is a flow chart showing an exemplary method of extending a work machine arm using a pre-selected priority of movement.
Figure 5:
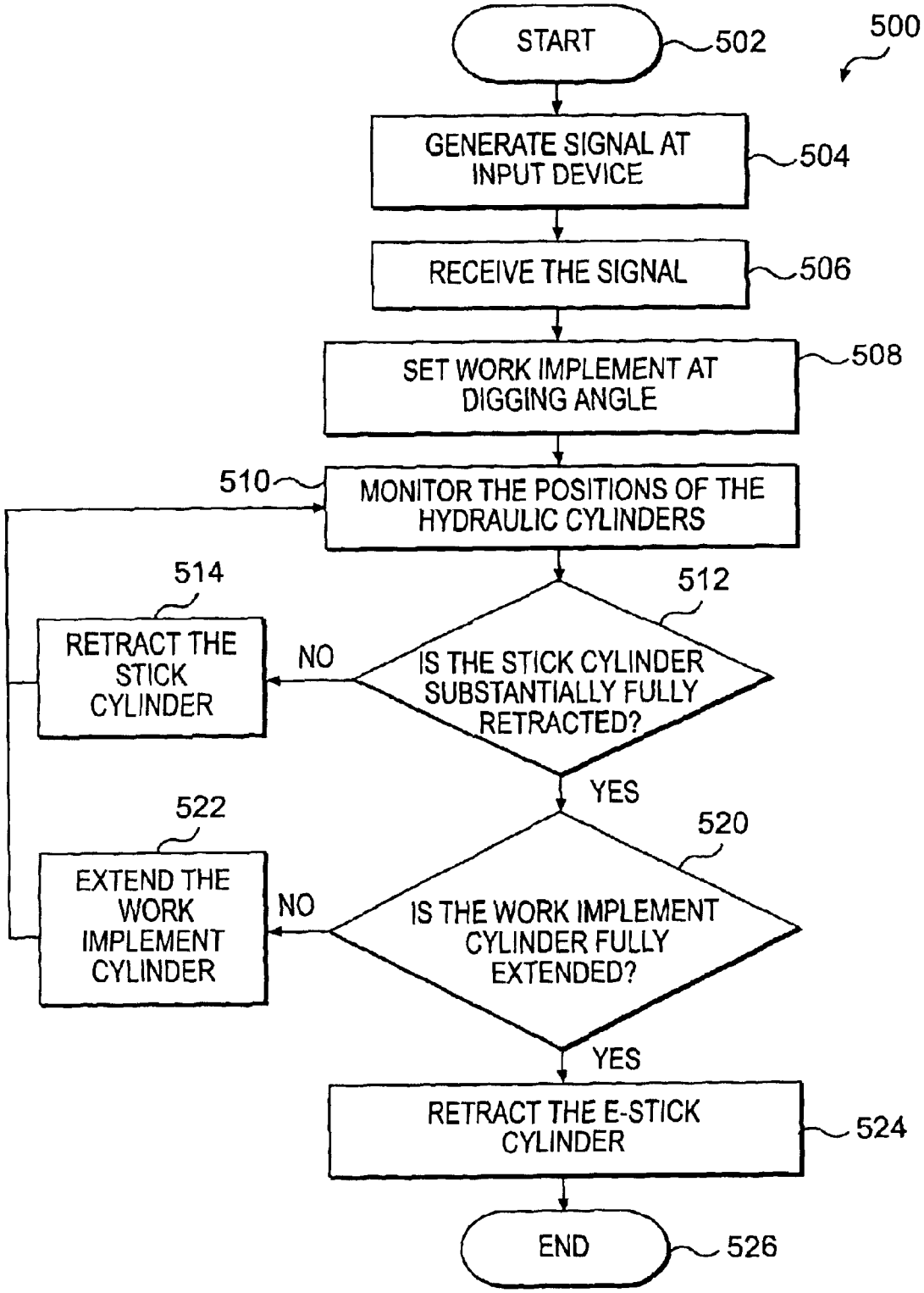
FIG. 5 is a flow chart showing an exemplary method of retracting a work machine arm using a pre-selected priority of movement.

The flowcharts of FIGS. 4 and 5 illustrate an exemplary method of extending and retracting a work machine arm according to an exemplary pre-selected priority of movement.

INDUSTRIAL APPLICABILITY

An exemplary mode is described with reference to FIGS. 4 and 5. FIG. 4 illustrates a flow chart 400 detailing the extension of the work machine arm 102 from a carry position to a fully extended or a maximum reach position according to an exemplary pre-selected priority of movement. FIG. 5 illustrates a flow chart 500 detailing retraction of the work machine arm 102 from the maximum reach position according to the exemplary pre-selected priority of movement. In the exemplary pre-selected priority of movement, the stick cylinder 114 has the first priority, the work implement cylinder 118 has the second priority, and the extendable stick cylinder 116 has the third priority. The boom cylinder 112, in this exemplary embodiment, is operated independent of the pre-selected priority of movement. In this example, the pre-selected priority of movement for retraction is not the reverse of the pre-selected priority of movement for extension, but instead, the same pre-selected priority of movement is assigned to both extension and retraction of the work machine arm 102. It should be noted that the same or different pre-selected priority of movements may be assigned to extension and retraction of the work machine arm 102.

The flow chart 400 begins at a start step 402. At a step 404, a signal is generated by the input device 202 to extend the work machine arm 102. The control module 204 receives the signal at a step 406, and monitors the positions of the hydraulic cylinders 114, 116, 118 associated with the work machine arm 102, at a step 408. This may be accomplished using the displacement sensors 218, 220, 222 that are associated with the hydraulic cylinders 114, 116, 118 and that send signals to the control module 204 indicative of the position or extension amount of the hydraulic cylinders 114, 116, 118.

In this exemplary embodiment of a priority of movement mode, the stick 106 has priority over the other components of the work machine arm 102. Accordingly, the hydraulic cylinders associated with the E-stick 108 and the work implement 110 may not be extended or retracted until the stick cylinder 114 is extended beyond a pre-selected extension amount or point. The pre-selected point may be a position where the stick cylinder 114 is substantially fully extended. Thus, the control module 204 will extend the stick cylinder 114 to the pre-selected point before moving the E-stick cylinder 116 and the work implement cylinder 118. If the stick cylinder 114 is not substantially fully extended, the control module 204 may not move the E-stick cylinder 116 and the work implement cylinder 118. In one exemplary embodiment, a transitioning feature may slow, or ramp down, the velocity of one hydraulic cylinder, such as the stick cylinder 114 when it is extended or retracted beyond the pre-selected point, while at the same time, ramping up the velocity of the next hydraulic cylinder, such as the E-stick cylinder 116, to smoothly transition between cylinders. This transitioning feature may be applied to any cylinder, whether extending or retracting.

In this exemplary embodiment, and based upon the pre-selected priority of movement, the control module 204 determines whether the stick cylinder 114 is substantially fully extended, at a step 410. If the stick cylinder 114 is not substantially fully extended, the stick cylinder 114 is further extended at a step 412. As the stick cylinder is extended at step 412, the position of the stick cylinder 114 is continually monitored at step 408. Once the stick is moved to the pre-selected point or substantially fully extended at step 410, other cylinders 116, 118 associated with the work machine arm 102 may be allowed to further extend the work machine arm 102 according to the pre-selected priority of movement. In this exemplary embodiment, if the stick is substantially fully extended at step 410, the work implement 110 may then be moved by the work implement cylinder 118.

If at step 410 the work implement cylinder 118 is substantially fully extended, the pre-selected priority of movement allows movement of the work implement cylinder 118. At a step 418, the control module 204 determines whether the extension amount of the work implement 110 is substantially fully extended. It should be understood that due to the configuration of the exemplary work machine arm 102 shown and described with reference to FIG. 1, that when the work implement cylinder 118 is fully retracted, the work implement 110 is fully extended, or at a maximum reach with respect to the stick 106 and the E-stick 108.

If the work implement cylinder 118 is not fully retracted at a step 420, the work implement cylinder 118 is further retracted. The position of the work implement cylinder 118 is continuously monitored at step 408 by the work implement displacement sensor 222 and the control module 204. If the work implement cylinder 118 is fully retracted at step 420, the E-stick cylinder 116 may be extended at a step 422. Full extension of the E-stick results in the full extension of the work machine arm 102, providing a maximum reach. Accordingly, at a step 424, the extension ends. It should be noted that at any point during extension of the work machine arm 102, the operator may stop the extension simply by eliminating the signal or generating a contrary signal at the input device 202.

The flow chart 500 of FIG. 5 describes an exemplary method for retracting the work machine arm 102 from the fully extended position. The method described in flow chart 400 and the method to be described in flow chart 500 may be associated with the same mode, such as the digging mode.

The flow chart 500 starts at a step 502. At a step 504, a signal is generated at the input device 202 to move the hydraulic cylinders 114, 116, 118 associated with the work machine arm 102. At a step 506, the control module 204 receives the signal from the input device 202. Because this exemplary mode is a digging mode, at a step 508, the work implement 110 may be set at a digging angle, such as, for example, 30° with respect to the ground. Further, because the pre-selected priority of movement may be employed with a system for coordinated movement, the work implement 110 may be maintained at the digging angle during the process described for retracting other components of the work machine arm 102.

At a step 510, the positions of the hydraulic cylinders 114, 116, 118 are monitored by the displacement sensors 218, 220, 222. At a step 512, the control module 204 determines whether the stick cylinder 114 is substantially fully retracted. Because the stick cylinder 114 has the highest priority of movement, the control module 204 may not change the extension amounts of the E-stick cylinder 116 and the work implement cylinder 118 until the stick cylinder 114 is substantially fully retracted. If the stick cylinder 114 is not substantially fully retracted, at a step 514, the stick cylinder 114 is retracted. Step 510 monitors the position of the stick cylinder to determine when the stick cylinder 114 is substantially fully retracted. According to the pre-selected priority of movement, at step 512, after the stick cylinder 114 is substantially fully retracted, the work implement cylinder 118 may be moved next.

At a step 520, the control module determines whether the extension amount of the work implement cylinder 118 is fully extended. When the work implement cylinder 118 is fully extended, the work implement 110 is in a fully retracted position or, if the work implement is a bucket, the work implement 110 is in a fully curled position.

If the extension amount of the work implement cylinder 118 is not fully extended, the position of the work implement cylinder 118 may be monitored by the work implement displacement sensor 222 and the control module at step 510. If the work implement cylinder 118 is fully extended, the E-stick cylinder 116 may be retracted. When the E-stick cylinder 116 is fully retracted, the process ends at a step 526.

In the exemplary mode described with reference to FIGS. 4 and 5, the retraction priority is not the reverse of the extension priority. This is due to the desire during digging to minimize the use and extension of the E-stick cylinder based upon this exemplary pre-selected priority of movement.

Further, although the exemplary embodiment of a digging mode described with reference to FIGS. 4 and 5 includes a pre-designated cylinder position that is fully extended or retracted before other cylinders may move according to the priority of movement, such full extension or retraction is not required. In other embodiments, the cylinders need only be extended or retracted beyond any designated point to activate the next priority in the pre-selected priority of movement.

Although in the exemplary embodiment describe above, the boom 104 is separately operated, and not controlled by the priority of movement, in another embodiment, the boom 104 is also controlled to the priority of movement of the present invention. Additionally, although the disclosed system is described with reference to a work machine arm 102 for digging, the pre-selected priority of movement may be used on other work machines, including, for example, excavators, shovels, telescopic material handlers, forklifts, etc. For example, if the work implement were pallet forks, the pre-selected priority of movement may operate to prevent tipping the pallet forks.

In another example, the pre-selected priority of movement may be used to control a work machine arm during other work scenarios, including, for example, when the work implement 110 is a hydraulic hammer or a vibratory compactor. The pre-selected priority of movement may prioritize the movement of the stick 106 and E-stick 108, and may be coordinated so that the hydraulic hammer or vibratory compactor is always vertical, with only the stick 108 and E-stick 110 being prioritized.

Other embodiments will be apparent to those skilled in the art from consideration of the specification and practice disclosed herein. It is intended that the specification and examples be considered as exemplary only, with a true scope of the disclosure being indicated by the following claims.

What is claimed is:

1. A method of controlling the movement of a work machine arm having a series of hydraulic cylinders operatively engaged with the work machine arm, comprising:

receiving a signal from an input device to change the position of the work machine arm;

determining an extension amount of one or more of the series of hydraulic cylinders; and changing the extension amount of one or more of the series of hydraulic cylinders to effect the change in the position of the work machine arm, wherein the changes in the extension amount of the one or more of the series of hydraulic cylinders are ordered based on a pre-selected priority of movement, wherein the pre-selected priority of movement includes extending or retracting a stick cylinder of the series of hydraulic cylinders beyond a pre-designated position before changing an extension amount of an extendable stick cylinder of the series of hydraulic cylinders.

2. The method of claim 1, wherein the pre-selected priority of movement prevents the extension amount one or more of the series of hydraulic cylinders from changing until the extension amount of another of the series of hydraulic cylinders is substantially fully extended or retracted.

3. The method of claim 1, wherein the pre-selected priority of movement includes substantially fully extending or retracting the stick cylinder before changing one of the extension amount of the extendable stick cylinder and the reach of a work implement relative to a stick associated with the stick cylinder.

4. The method of claim 1, wherein determining an extension amount of the series of hydraulic cylinders includes:

determining the extension amount of the stick cylinder with a stick sensor;

determining the extension amount of the extendable stick cylinder with an extendable stick sensor; and determining the extension amount of a work implement cylinder with a work implement sensor.

5. The method of claim 4, wherein the pre-selected priority of movement includes changing the work implement cylinder extension to increase or decrease the reach of a work implement relative to a stick after the stick cylinder is substantially fully extended or retracted.

6. The method of claim 5, wherein the pre-selected priority of movement includes changing the extendable stick cylinder extension amount after the work implement cylinder is substantially fully extended or retracted.

7. The method of claim 1, wherein the pre-selected priority of movement for an extension of the work machine arm is different than the pre-selected priority of movement for a retraction of the work machine arm.

8. The method of claim 1, further including selecting a mode from a mode selector to change the pre-selected priority of movement.

9. The method of claim 1, wherein changing the extension amount to effect the change in position includes transitioning movement between the one or more of the series of hydraulic cylinders by ramping down the velocity of the one or more of the series of hydraulic cylinders while ramping up the velocity of another one or more of the series of hydraulic cylinders.

10. A system for controlling the movement of a work machine arm having a series of hydraulic cylinders operatively engaged with the work machine arm, comprising:

an input device operable to generate a signal to change the position of the work machine arm;

at least one sensor associated with one or more of the series of hydraulic cylinders for determining an extension amount of the one or more of the series of hydraulic cylinders; and a control module adapted to receive the signal from the input device and to change the extension amount of one or more of the series of hydraulic cylinders to effect the change in the position of the work machine arm, wherein the changes in the extension amount of the one or more of the series of hydraulic cylinders are ordered based on a pre-selected priority of movement, wherein the pre-selected priority of movement is configured to extend or retract a stick cylinder of the series of hydraulic cylinders beyond a pre-designated position before changing an extension amount of an extendable stick cylinder of the series of hydraulic cylinders.

11. The system of claim 10, wherein the control module includes a memory adapted to store the pre-selected priority of movement, and wherein the pre-selected priority of movement allows the extension amount of one or more of the series of hydraulic cylinders to change after the extension amount of another of the series of hydraulic cylinders is substantially fully extended or retracted.

12. The system of claim 10, wherein the control module includes a memory adapted to store the pre-selected priority of movement, and the pre-selected priority of movement fully extends or retracts the stick cylinder before changing one of the extension amount of the extendable stick cylinder and the reach of a work implement relative to a stick associated with the stick cylinder.

13. The system of claim 10, further including:

a stick sensor associated with the stick cylinder for determining the extension amount of the stick cylinder;

an extendable stick sensor associated with the extendable stick cylinder for determining the extension amount of the extendable stick cylinder; and a work implement sensor associated with a work implement cylinder for determining the extension amount of the work implement cylinder.

14. The system of claim 13, further including:

a work implement associated with the work implement cylinder; and a stick associated with the stick cylinder, wherein the control module is adapted to change the work implement cylinder extension to increase or decrease the reach of the work implement relative to the stick after the stick cylinder is substantially fully extended or retracted.

15. The system of claim 14, wherein the control module is adapted to change the extendable stick cylinder extension amount after the work implement cylinder is substantially fully extended or retracted.

16. The system of claim 10, wherein the pre-selected priority of movement for an extension of the work machine arm is different than the pre-selected priority of movement for a retraction of the work machine arm.

17. The system of claim 10, further including a mode selector adapted to change the pre-selected priority of movement.

18. The system of claim 17, wherein the mode selector changes the pre-selected priority of movement for different types of work implements.

19. The system of claim 17, wherein the mode selector changes the pre-selected priority of movement for different digging projects.

20. The system of claim 10, wherein the control module is adapted to effect the change in position by transitioning movement between the one or more of the series of hydraulic cylinders by ramping down the velocity of the one or more of the series of hydraulic cylinders while ramping up the velocity of another one or more of the series of hydraulic cylinders.

21. An apparatus for controlling the movement of a work machine arm having a series of hydraulic cylinders operatively engaged with the work machine arm, comprising:

means for receiving a signal from an input device to change the position of the work machine arm;

means for determining an extension amount of one or more of the series of hydraulic cylinders; and means for changing the extension amount of one or more of the series of hydraulic cylinders to effect the change in the position of the work machine arm, wherein the changes in the extension amount of the one or more of the series of hydraulic cylinders are ordered based on a pre-selected priority of movement, wherein pre-selected priority of movement is configured to extend or retract a stick cylinder of the series of hydraulic cylinders beyond a pre-designated position before changing an extension amount of an extendable stick cylinder of the series of hydraulic cylinders.

22. The apparatus of claim 21, wherein the pre-selected priority of movement allows the extension amount of one or more of the series of hydraulic cylinders to change only after the extension amount of another of the series of hydraulic cylinders is substantially fully extended or retracted.

23. The apparatus of claim 21, wherein the pre-selected priority of movement includes substantially fully extending or retracting the stick cylinder before changing one of the extension amount of the extendable stick cylinder and the reach of a work implement relative to a stick associated with the stick cylinder.

24. The apparatus of claim 21, wherein determining an extension amount of the series of hydraulic cylinders includes:

means for determining the extension amount of the stick cylinder with a stick sensor;

means for determining the extension amount of the extendable stick cylinder with an extendable stick sensor; and means for determining the extension amount of a work implement cylinder with a work implement sensor.

25. The apparatus of claim 24, wherein the pre-selected priority of movement includes changing the work implement cylinder extension to increase or decrease the reach of a work implement relative to a stick after the stick cylinder is substantially fully extended or retracted.

26. The apparatus of claim 25, wherein the pre-selected priority of movement includes changing the extendable stick cylinder extension amount after the work implement cylinder is substantially fully extended or retracted.

27. A controller for controlling the movement of a work machine arm having a series of hydraulic cylinders operatively engaged with the work machine arm, comprising:

an input device operable to send a control signal to change the position of the work machine arm;

a series of valves operably associated with the series of hydraulic cylinders; and a control module adapted to receive the control signal from the input device, and adapted to send a signal to the series of valves to change the extension amount of one or more of the series of hydraulic cylinders to effect the change in the position of the work machine arm, wherein the changes in the extension amount of the one or more of the series of hydraulic cylinders are ordered based on a pre-selected priority of movement, wherein the pre-selected priority of movement is configured to extend or retract a stick cylinder of the series of hydraulic cylinders beyond a pre-designated position before changing an extension amount of an extendable stick cylinder of the series of hydraulic cylinders.

28. The controller of claim 27, further including:

a stick sensor associated with the stick cylinder for determining the extension amount of the stick cylinder;

an extendable stick sensor associated with the extendable stick cylinder for determining the extension amount of the extendable stick cylinder; and a work implement sensor associated with a work implement cylinder for determining the extension amount of the work implement cylinder.

29. The controller of claim 27, wherein the control module includes a memory adapted to store the pre-selected priority of movement, and the pre-selected priority of movement allows the extension amount of one or more of the series of hydraulic cylinders to change after the extension amount of another of the series of hydraulic cylinders is substantially fully extended or retracted.

30. The controller of claim 27, wherein the control module includes a memory adapted to store the pre-selected priority of movement, and the pre-selected priority of movement substantially fully extends or retracts a boom cylinder and the stick cylinder before changing one of the extension amount of the extendable stick cylinder and the reach of a work implement relative to a stick associated with the stick cylinder.

31. A work machine comprising:

a work machine arm including, a boom having a boom cylinder, a stick pivotally connected to the boom, the stick having a stick cylinder, an extendable stick slidably connected to the stick, the extendable stick having an extendable stick cylinder, and a work implement pivotally connected to the extendable stick, the work implement having a work implement cylinder;

a stick sensor associated with the stick cylinder for determining the extension amount of the stick cylinder;

an extendable stick sensor associated with the extendable stick cylinder for determining the extension amount of the extendable stick cylinder;

a work implement sensor associated with the work implement cylinder for determining the extension amount of the work implement cylinder;

an input device operable to generate a signal to change the position of the work machine arm; and a control module adapted to receive the signal from the input device and to change the extension amount of one or more of the hydraulic cylinders to effect the change in the position of the work machine arm, wherein the changes in the extension amount of the hydraulic cylinders are ordered based on a pre-selected priority of movement.

32. The system of claim 31, wherein the control module includes a memory adapted to store the pre-selected priority of movement, and wherein the pre-selected priority of movement allows the extension amount of one or more of the hydraulic cylinders to change only after the extension amount of another of the hydraulic cylinders is substantially fully extended or retracted.

33. The system of claim 31, wherein the control module includes a memory adapted to store the pre-selected priority of movement, and the pre-selected priority of movement substantially fully extends or retracts the stick cylinder before changing one of the extension amount of the extendable stick cylinder and the reach of the work implement relative to the stick.

34. The system of claim 31, wherein the pre-selected priority of movement is configured to extend or retract the stick cylinder beyond a pre-designated position before changing an extension amount of the extendable stick cylinder.

* * * * *